United States Patent [19]

Knapp

[11] 4,242,771

[45] Jan. 6, 1981

[54] PIPELINE PIG

[76] Inventor: Kenneth M. Knapp, 1209 Hardy St., Houston, Tex. 77020

[21] Appl. No.: 58,064

[22] Filed: Jul. 16, 1979

[51] Int. Cl.[3] ..... B08B 9/04

[52] U.S. Cl. ..... 15/104.06 R

[58] Field of Search ..... 15/104.06 R, 104.06 A, 15/3.5, 3.51; 137/268

[56] References Cited

U.S. PATENT DOCUMENTS

| | | | |
|---|---|---|---|
| 3,879,790 | 4/1975 | Girard | 15/104.06 R |
| 4,016,620 | 4/1977 | Powers | 15/104.06 R |
| 4,122,575 | 10/1978 | Sagawa | 15/104.06 R |

FOREIGN PATENT DOCUMENTS

| | | | |
|---|---|---|---|
| 1367667 | 9/1974 | United Kingdom | 15/104.06 R |
| 278318 | 3/1970 | U.S.S.R. | 15/104.06 R |

*Primary Examiner*—Edward L. Roberts

*Attorney, Agent, or Firm*—Gunn, Lee & Jackson

[57] ABSTRACT

An improved pipeline pig is described, there being alternate embodiments. The illustrated and preferred embodiment is a pipeline pig made of a foamed polyolefin, bullet-shaped body having a cylindrical outer wall and a strip of heavier density resilient material across the outer cylindrical wall. A stud having the form of an inverted screw or bolt with a pointed tip is placed in the pig body and protrudes at the strip. The strip reinforces the stud and helps hold it in position. The stud preferably has an enlargement near the bottom portions thereof which enables the stud to be firmly anchored in position. The tip of the stud breaks hard deposits accumulated on the wall of a pipeline and enables the pipeline pig to sweep the deposits away.

11 Claims, 4 Drawing Figures

FIG. 1
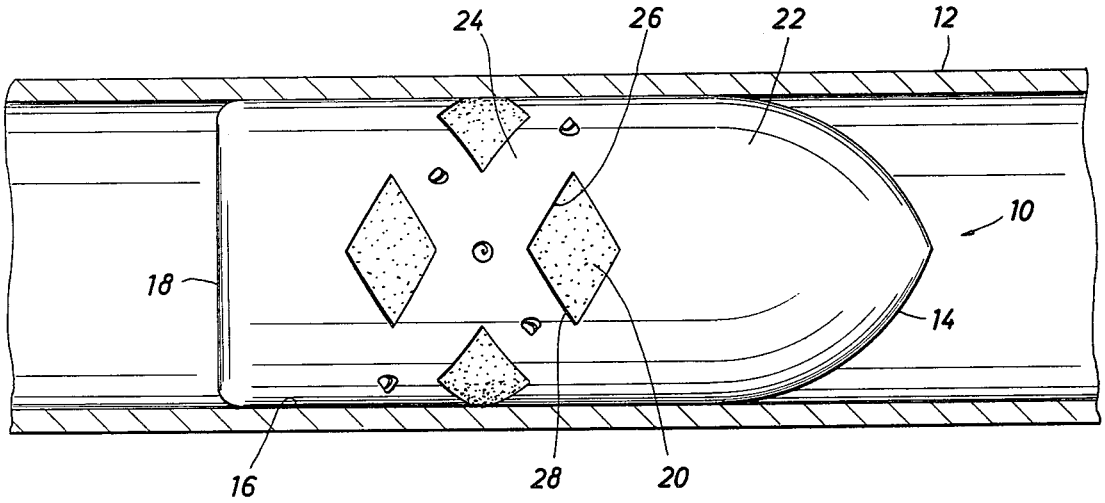
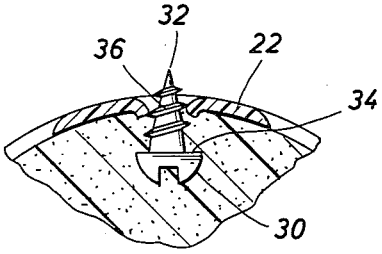
FIG. 2
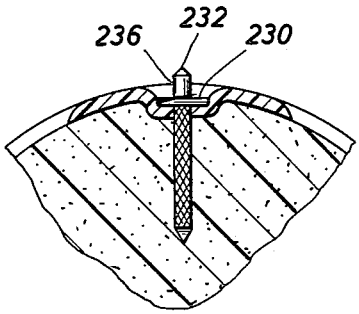
FIG. 3
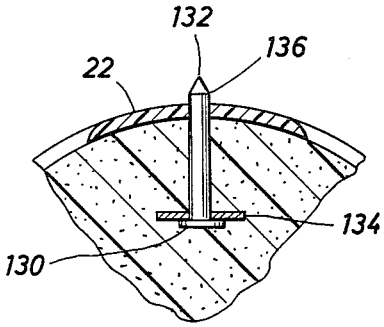
FIG. 4

PIPELINE PIG

BACKGROUND OF THE DISCLOSURE

Pipeline pigs are used to clean pipelines. Pipelines run the hazard of forming accumulations or deposits on the interior. Such deposits accumulate over a period of time from the product flowing through the pipeline. In some instances, this is no problem whatsoever. The deposit may form very slowly and, even after formation, may be removed easily because it is relatively soft. In other circumstances, the deposit placed on the interior of the pipeline may be very hard. Depending on the locale, artesian water will include a significant mineral content. The formation of internal pipe scale is accelerated where the water is hot. Where highly mineralized artesian water is heated and flows through a pipeline, scale coating in the pipe is accelerated. It is possible to coat a pipe on the interior to almost totally plug the pipeline. The internally coated pipe scale must be cleaned. Sometimes, cleaning can be achieved with other types of pigs. However, it has been found that the pig described in this specification is superior in many cleaning operations. It is particularly able to break up the scale on the interior of a pipe so that it can be removed in large pieces.

Pigs equipped with thousands of small points have been known before, and they will eventually remove pipe scale from a pipe. One such pig is supplied by the firm Polly-Pig by Knapp, Inc., of Houston, Tex., and is sold under the trademark "Superjavalina." It is a very good pig for many purposes. One of its virtues arises from the incorporation of thousands of small, relatively short metal chisels which cut the pipe scale away. So to speak, they collectively cut away a cloud of dust. By contrast, the pig of this disclosure cuts the scale only in a few places, but it tends to cut deeply and breaks away large pieces or chunks of the pipe scale. As the large pieces are broken from the unwanted pipe coating, they are flushed by the fluid flow which propels the pig through the pipeline. This enables the line to be cleaned and flushed with just a few passes of the pig. This enables the pipeline to be restored to full service more promptly.

One advantage of the highly inventive pig of this disclosure is that it appears to work even better with coatings which are relatively harder than most coatings. Indeed, the relative hardness and brittleness of the coating enhances the operation of the pipe cleaning pig of this disclosure. Enhancement is obtained in that soft, pliant coatings will permit the sharp, pointed stud to dig and gouge, but will not necessarily initiate cracks running through the coating which break the coating free. By contrast, a brittle pipe coating which is cut in a vigorous fashion by the chiseling point of the stud associated with this pig tends to break loose in large pieces as cracks and fissures are propogated from the line of contact of the stud with the pipe scale. This breaks up the pipe coating and permits it to flake away in larger pieces. It has been surprisingly learned that it is, therefore, better to reduce the number of metal chisels striking against the internal scale. This is borne out by the reduction in points of contact against the internal scale from the "Superjavalina" pig which approximates hundreds, or perhaps thousands, of points per square inch to the present disclosure which utilizes only a few metal chisels on the entire pig. This reduction of several hundredfold to a few stud points on the body of the pig enables the hard internal pipe scale to break up in large pieces and permits its removal more rapidly.

The present apparatus has the further advantage of removing other kinds of hard coatings. For instance, highly irregular coatings are easily removed. One kind of highly irregular coating is that found in pipelines which carry seawater and which do not have sophisticated water filtration apparatus. Such pipelines (for instance, communicating with a cooling tank) often accumulate aquatic shell deposits of a very random distribution, thickness and hardness.

The improved pig of the present apparatus undergoes significant stress in operation. The tip of the stud may undergo significant bending as it impacts a brick-like pipe scale deposit. The brick-like deposit may break and shatter, but only if the stud maintains its relative position in the pig as the pig traverses the pipeline. It is important that the stud be firmly anchored in the pig to resist the wear and tear of operation. Failure of the pig can be manifested by tearing the stud out of the pig body. One important advantage of an embodiment disclosed herein is the incorporation of an enlarged shoulder or facing area near the bottom end of the stud which anchors the stud in position and prevents its tearing free. Thus, the tip of the stud may be violently deflected, but the resilience of the body of the pig enables the stud to accommodate such deflections while the stud remains intact with the body. The transverse shoulder anchors the stud in position.

The present invention has as one of its objects the provision of a pipeline pig which is pressure propelled through a pipeline with a plurality of studs mounted in spaced locations and including spirals thereon which tend to rotate the pig as it traverses a pipeline, the studs gouging and chiseling away hard pipe scale.

BRIEF SUMMARY OF THE DISCLOSURE

The apparatus disclosed herein comprises a pipeline pig. The pig has a cylindrical outer wall adapted to seal against the wall of a pipeline. A transverse rear end is incorporated to enable the pig to be pressure propelled by the fluid flowing in the pipeline. In the preferred embodiment, the pig is formed of a first density of polyurethane foam (other types of foam may be used). This defines the central body of the pig. There is an outer coating around the pig, the coating receiving a plurality of studs protruding through it. The coating is of higher density elastomeric material to provide reinforcing to the stud which tends to anchor studs radially outwardly directed in the body of the pig. Each stud has an outer tip which is exposed to cut, chisel and break away pipe scale. The stud preferably incorporates an enlarged internal shoulder well within the body of the pig to anchor the stud in the pig. The stud is formed of an elongate body having the tip at the outer end and a long shank portion which extends in the pig. Preferably, the stud is integrally formed into the pig at the time of manufacture by fabricating the pig around the stud placed in the mold where the pig is fabricated.

BRIEF DESCRIPTION OF THE DRAWINGS

FIG. 1 shows the improved pipeline pig of the present invention received in a pipeline for cleaning internal pipe scale;

FIG. 2 is a sectional view through a stud in a pig body in accordance with the present disclosure;

FIG. 3 discloses an alternate embodiment to the construction of FIG. 2; and

FIG. 4 is another alternate embodiment in accordance with the teachings of the present invention.

DETAILED DESCRIPTION OF THE ILLUSTRATED EMBODIMENT

In FIG. 1 of the drawings, a pipeline 12 receives a pig 10 having a nose or tip 14 at the front end. It is formed with an outer cylindrical wall 16 to the rear of the nose. It has a transverse back end 18 which is formed of a nonporous external coating of heavy density polyolefin. The skin prevents fluid from entering the pig in excessive quantities, thereby bypassing the pig. The pig is propelled by the force imparted to the back face 18 to travel through the pipeline.

The pig body 20 is formed of a resilient foam of a specified density from a polyolefin material. Polyurethane is the preferred material, and the density has a wide range or variation. Densities as low as 2.0 pounds per cubic foot are acceptable, except that foam of such light density may not have the holding strength. The rigors of service thus determine the minimum density for the foam. The body, therefore, must have enough material in it to have strength to grip the studs to be described.

Foam densities in the range of 10.0 to 20.0 pounds per cubic foot are ordinarily acceptable. Higher densities are usually not needed. While they add strength, they also increase cost to an unacceptable level.

The pig is formed of an outer skin 22. The skin 22 is a thicker outer coating of polyolefin, typically of heavier density and applied in a specified pattern. The outer coating 22 shown in FIG. 1 is exemplary. Several things should be noted about it. It is coated over the nose to define the bullet-shaped construction shown in FIG. 1. It has a thickness of perhaps one-sixteenth to one-quarter inch. This depends on a number of scale factors. The outer coating 22 defines the strap-like portion shown at 24 at the central portions of the pig. The coating 24 is shaped to define a leading edge 26 which frictionally encounters the wall of the pipe and the coating thereon to impart a rotating force to the pig. While there is additionally an edge at 28, construction of the edges 26 and 28 at different angles relative to the axis of the pig will cause rotation. Alternatively, a single set of encircling stripes somewhat in the fashion of a barber pole will also impart rotation. The outer covering is better shown in the sectional views. There, it is not totally inclusive of the body of the pig. Rather, it is formed into strips which extend around the pig. This cuts the cost of the pig. This cuts the quantity of plastic material required to fabricate the pig. Moreover, the covering portion shown in the sectional views is an anchor which connects to the upper portions of the studs installed thereat for lateral reinforcing.

FIG. 2 shows a stud 30 which has the form of a screw with head. It has a protruding tip 32, which tip fractures the pipe coating to break it away for removal. The tip 32 is the tip of a typical screw which extends to a shoulder 34. It has a shank 36 of specified length which extends between the tip 32 and the shoulder 34. The tip 32 serves as a breaking instrument which fractures the coating, enabling it to be flushed away. The shank defines suitable length for the tool so that the shoulder 34 is positioned at a suitable depth within the pig body to prevent pulling free. It will be understood that the tip, in operation, will be deflected to the side. It is held in the radial upright position by the thicker coating 22 on the exterior. The tip deflects, thereby imparting flexure to the stud which is held in position by the shoulder 34. The shoulder 34 has some suitable lateral extent. The precise measure of shoulder size is subject to a wide range of variation, and it is significant to note that the incorporation of the shoulder 34 on the metal stud engages the foam body which is poured around the stud at the time of fabrication to hold the stud in position. The stud is held in position by the grip of the foam body which is formed about it and which is in contact with the shank and lower portions of the stud.

The particular embodiment of FIG. 2 utilizes a wood screw as a convenient source of stud component material. The stud is installed in the mold utilized to fabricate the pig of the present invention, and the pig body is formed about it. After the softer foam body is formed, the tougher outer coating is applied at 22 to complete the construction. It will grip the shank of the stud at the place where the stud emerges from the body.

The embodiment shown in FIG. 2 utilizes stock materials available for fabrication of the equipment. FIG. 4 shows an alternate embodiment which also uses stock materials. Specifically, it includes a tip 132 on a shank 136 which extends to the interior where a washer 134 is included, the washer 134 defining a shoulder which locks the stud in the body. The washer 134 is held in position by the head 130 of the shank. Suitable commercial materials that can be used include a washer sized to fit around the shank of a nail. Again, it protrudes through the outer covering 22 in the form of a strip around the surface of the body.

The embodiments of FIG. 2 and 4 are installed at the time of fabrication of the pig, placing the studs in the mold. To this end, the mold can be drilled and the tip 132 inserted into drilled holes to locate and fasten the stud in the mold. The washer 134 is preferably sized to frictionally grip the shank 136 so that it holds the end-located position.

FIG. 3 discloses an alternate mode of fabrication and an alternate form of stud. FIG. 3 incorporates a stud with a tip 232 extending from the shank 236. The shank 236 supports a washer 230 which is on the exterior. The pig in FIG. 3 is first formed. The stud is driven into the pig either by suitable force or, in the alternative, by drilling a hole in the pig and gluing the stud into the body of the pig. The stud is driven into the pig to a depth where the shoulder 230 limits penetration.

The stud shaft 236 is preferably serrated to rough its outer surface to enable it to grip the foam body. The foam body thus holds to the extent that an adhesive and serrations on the shank will permit. It is possible, however, to pull the stud free of the pig body utilizing the embodiment shown in FIG. 3.

Tearing of the stud from the pig in FIG. 3 is not constrained by the shoulders 34 and 134 shown in the other embodiments. The washer 230, typically integrally constructed with the stud, serves as a limit means which prevents driving the stud excessively deep into the pig whereby the tip 232 is not in position to contact pipe scale. There is, of course, a slenderness ratio of length to thickness which portends undue ease of penetration of a stud into the pig. The optimum value is variant over a wide range depending on the foam density of the pig body, the diameter of the stud and other factors. In ordinary circumstances, the stud preferably has a head 30 or 130 having a width of about one-quarter inch or greater for foam having a density in the range of about 10.0 pounds per cubic foot.

The shoulders 34 and 134 have a width and, therefore, a surface area which depend somewhat on scale. For small pigs, such as pigs having a diameter of about 4.0 inches or so, the shoulder should be in the range of 0.50 inch to about 1.0 inch in diameter. Shoulders of a smaller size may not take as much abuse, particularly in lightweight foam bodies, as shoulders in the described range. Excessively large shoulders provide enhanced grip, but exceedingly large shoulders simply are not required. A large shoulder of perhaps 2.0 inches in diameter would not particularly enhance the operation of the pig over shoulders within the described range. By contrast, in a large pig of nominal 48.0 inches diameter, the loading forces impacting the stud are much greater. The stud should, therefore, be scaled to a larger size with a larger shoulder. Again, this is a scale factor which can be varied depending on the foam density of the pig body, the depth of the pipe scale to be removed, the dimensions of the stud and other factors.

The present invention thus has multiple embodiments. The first and preferred embodiment utilizes the internally located shoulder to anchor the stud. For a more easily fabricated pig, the stud of FIG. 3 can be used. It runs the hazard of easy removal in comparison with the studs shown in FIGS. 2 and 4. The foam body density ranges from a low of about 5.0 pounds per cubic foot to about 10.0 pounds per cubic foot. The low is determinative to strength of the body to resist pulling the stud free. If greater strength is required, greater density will yield more resistance to pulling free. The maximum density is limited by cost inasmuch as greater density requires more raw ingredients. The covering is in the range of about 50.0 to 80.0 pounds per cubic foot. This density range in a covering of about one-eighth inch to 1.0+ inch thickness defines a very acceptable means for anchoring the studs in location against expected wear and tear.

The foregoing is directed to the preferred embodiment, but the scope of the present invention is determined by the claims which follow.

I claim:

1. A pipeline pig comprising:

(a) a pig body having (1) an outer surface adapted to be partly contacted against the wall of a pipe to be cleaned;

(2) a transversely extending end portion adapted to respond to a pressure gradient acting thereon to push said pig body along the pipeline;

(3) a central portion formed of a resilient material; and (b) a stud having (1) an elongate shank;

(2) a tip on said shank converging to a point and adapted to be positioned protruding from said body to engage pipe wall located deposits; and (3) shoulder means on said shank for embedding in said central portion to position said shank extending radially outwardly therefrom through said outer surface to position said tip protruding from said body, said shoulder means cooperating with said central portion permitting flexure of said shank upon deflection of said tip.

2. The apparatus of claim 1 wherein:

(a) said shoulder means is located at or near a second end of said stud; and (b) said shoulder means comprises a surface larger in size than said shank to define a body engaging area within said body such that said shoulder means retains said shank in said body.

3. The apparatus of claim 2 including an external coating of resilient material on said body which surrounds said tip at the location where said tip emerges from said body and wherein said external coating has a density greater than the density of said body.

4. The apparatus of claim 3 wherein said external coating is shaped to define a leading edge on said body which encounters the pipe wall on movement and which extends about said body in an arrangement such that rotation is imparted to said body on translation along the pipe.

5. The apparatus of claim 1 including an external coating of resilient material on said body which surrounds said tip at the location where said tip emerges from said body and wherein said external coating has a density greater than the density of said body.

6. The apparatus of claim 5 wherein said external coating is shaped to define a leading edge on said body which encounters the pipe wall on movement and which extends about said body in an arrangement such that rotation is imparted to said body on translation along the pipe.

7. The apparatus of claim 6 wherein said body is made of foamed resilient material having a density of less than 10.0 pounds per cubic foot.

8. The apparatus of claim 7 wherein said external coating has a density in excess of 50.0 pounds per cubic foot and is adhered to said body.

9. The apparatus of claim 7 wherein said external coating fully covers said transversely extending end portion and extends forwardly in a helical strip about said body and terminates at said pointed nose.

10. The apparatus of claim 9 wherein said body is circular and said helical strip extends thereabout, and said stud is duplicated with at least two tips extending through said strip.

11. The apparatus of claim 6 wherein said body includes a pointed nose at one end and said transversely extending end portion is the opposite end thereof.

* * * * *